US011435168B2

(12) United States Patent
Schulein et al.

(10) Patent No.: US 11,435,168 B2
(45) **Date of Patent: *Sep. 6, 2022**

(54) CUT, SLASH AND/OR ABRASION RESISTANT PROTECTIVE FABRIC AND LIGHTWEIGHT SHAPED KNIT GARMENT MADE THEREFROM

(71) Applicant: SUPREME CORPORATION, Conover, NC (US)

(72) Inventors: Walter Gordon Schulein, Little Egg Harbor, NJ (US); Nathaniel H. Kolmes, Hickory, NC (US); Fred Elton Driver, Ronda, NC (US)

(73) Assignee: SUPREME CORPORATION, Conover, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/730,157

(22) Filed: Dec. 30, 2019

(65) Prior Publication Data

US 2020/0132418 A1 Apr. 30, 2020

Related U.S. Application Data

(63) Continuation of application No. 11/778,340, filed on Jul. 16, 2007, now Pat. No. 10,520,280.

(51) Int. Cl.

| | |
|---|---|
| ***D04B 1/24*** | (2006.01) |
| ***F41H 1/02*** | (2006.01) |
| ***A41D 1/04*** | (2006.01) |
| ***A41D 31/24*** | (2019.01) |
| *D04B 1/12* | (2006.01) |

(52) U.S. Cl.

CPC ..... *F41H 1/02* (2013.01); *A41D 1/04* (2013.01); *A41D 31/24* (2019.02); *D04B 1/246* (2013.01); *D10B 2501/04* (2013.01)

(58) Field of Classification Search

CPC ..... D02G 3/442; D02G 3/12; D02G 3/047; D02G 3/185; A41D 19/0041; A41D 27/10; A41D 2500/10; A41D 31/0055; A41D 19/0013; A41D 19/01505; A41D 27/00; A41D 3/02; D04B 1/08; D04B 1/16; Y10S 2/912; Y10S 2/917

USPC ..... 2/2.5

See application file for complete search history.

(56) References Cited

U.S. PATENT DOCUMENTS

| | | | | |
|---|---|---|---|---|
| 4,777,789 | A * | 10/1988 | Kolmes | D02G 3/448 57/902 |
| 6,341,483 | B1 * | 1/2002 | Kolmes et al. | 57/249 |
| 6,349,531 | B1 * | 2/2002 | Kolmes et al. | 57/229 |
| 6,363,703 | B1 * | 4/2002 | Kolmes | 57/210 |
| 6,367,290 | B2 * | 4/2002 | Kolmes et al. | 66/172 R |

(Continued)

OTHER PUBLICATIONS www.inventors.about.com/library/weekly/aa082497, "History of Zippers"; accessed Mar. 20, 2008. (Year: 2006).*

(Continued)

*Primary Examiner* — Robert H Muromoto, Jr.

(74) *Attorney, Agent, or Firm* — Oblon, McClelland, Maier & Neustadt, L.L.P.

(57) ABSTRACT

A cut, slash and/or abrasion resistant shaped knit garment having both high cut resistance and preferably light fabric weight, a cut resistance of at least 1500 (as measured by ASTM-F1790-2005) and preferably a fabric weight of no more than 27.9 ounces/square yard (OPSY).

7 Claims, 3 Drawing Sheets

(56) References Cited

U.S. PATENT DOCUMENTS

| | | | | |
|---|---|---|---|---|
| 6,381,940 | B1 * | 5/2002 | Kolmes et al. | 57/245 |
| 6,467,251 | B1 * | 10/2002 | Kolmes | 57/230 |
| RE38,136 | E * | 6/2003 | Kolmes | 57/212 |
| 7,178,323 | B2 * | 2/2007 | Kolmes et al. | 57/210 |
| 7,214,425 | B2 * | 5/2007 | Kolmes | D02G 3/047 428/357 |
| 10,520,280 | B2 * | 12/2019 | Schulein | D04B 1/246 |
| 2005/0086924 | A1 * | 4/2005 | Kolmes | 57/229 |
| 2005/0186259 | A1 * | 8/2005 | Threlkeld et al. | 424/443 |
| 2006/0048495 | A1 * | 3/2006 | Threlkeld et al. | 57/210 |
| 2006/0177656 | A1 * | 8/2006 | Kolmes et al. | 428/364 |
| 2006/0213173 | A1 * | 9/2006 | Kolmes et al. | 57/210 |
| 2007/0144135 | A1 * | 6/2007 | Kolmes | D02G 3/38 57/232 |
| 2009/0019612 | A1 * | 1/2009 | Schulein | F41H 1/02 2/2.5 |

OTHER PUBLICATIONS

Google search: "define garment"; search results shown and dated 2008 (Year: 2008).*

Combined Chinese Office Action and Search Report dated Apr. 29, 2020 in corresponding Chinese Patent Application No. 201610670697.2 (with English Translation and English Translation of Category of Cited Documents) citing documents AA-AC therein, 20 pages.

* cited by examiner

CUT, SLASH AND/OR ABRASION RESISTANT PROTECTIVE FABRIC AND LIGHTWEIGHT SHAPED KNIT GARMENT MADE THEREFROM

CROSS REFERENCE TO RELATED APPLICATIONS

The present application is a Continuation of U.S. Ser. No. 11/778,340, filed Jul. 16, 2007, now allowed, the entire contents of which are incorporated herein by reference.

BACKGROUND OF THE INVENTION

1. Field of the Invention

The present invention relates to a lightweight protective fabric that is cut, slash and/or abrasion resistant, and garments made therefrom.

2. Discussion of the Background

In many industries and professions there is a need for protective wear that is cut and/or abrasion resistant, yet lightweight and comfortable for the wearer. From maintenance workers crawling through HVAC ventilation shafts to weekend warriors participating in various sporting events, many individuals need protection from cuts and scrapes as they go about their daily activities.

Typical examples of previous garments and modular systems are disclosed in U.S. Publication No. 2004/0199983 to Gillen; U.S. Pat. No. 6,892,392 to Crye; U.S. Pat. No. 6,698,024 to Graves; U.S. Pat. No. 6,263,509 to Bowen; U.S. Pat. No. 6,185,745 to Alger; U.S. Pat. No. 6,182,288 to Kibbee; U.S. Pat. No. 6,158,056 to Riley; U.S. Pat. No. 6,029,270 to Ost; U.S. Pat. No. 5,894,600 to Chenefront; U.S. Pat. No. 5,754,982 to Gainer; U.S. Pat. No. 5,718,000 to Ost; U.S. Pat. No. 5,717,999 to Lurry; U.S. Pat. No. 5,673,836 to Bush; U.S. Pat. No. 5,584,737 to Luhtala; U.S. Pat. No. 5,495,621 to Kibbee; U.S. Pat. No. 5,072,453 to Widder; U.S. Pat. No. 5,060,314 to Lewis; U.S. Pat. No. 4,497,069 to Braunhut; and U.S. Pat. No. 4,467,476 to Herbert, the disclosures of which are incorporated by reference herein in their entirety.

One industry where such protection is particularly important is the glass industry, where workers are subjected to frequent exposure to sharp edges of glass, either from large float glass panes to smaller glass panes, or from broken edges in the case of a mishap.

However, these and other known such garments suffer from numerous disadvantages. The garments are often unable to provide a satisfactory level of protection to a wearer of the garment, are easily damaged, are unwieldy and uncomfortable to the wearer, do not permit airflow therethrough, do not permit the escape of excess water vapor from the skin of the wearer, and often require the use of specialized over- or undergarments. Most of the modular systems in these patents require a central vest portion to be present in order to attach the other parts of the system.

Previous protective wear in the glass industry suffers from a variety of drawbacks, such as insufficient coverage of the wearer, the presence of metal grommets or other attachment devices which can scratch the surfaces of softer glass, inability to stretch in all directions, and often insufficient cut resistance or weak spots in the areas of seams.

An additional difficulty in preparing cut, slash and abrasion resistant fabrics and garments, is that in order to achieve sufficient cut and slash protection using high-performance fibers, the garments typically end up being too bulky, too heavy, and are difficult to put together, as the fabric cannot be readily cut to necessary size and shape without taking a high toll on the cutting apparatus.

Thus there is a need for a fabric that is cut, slash and/or abrasion resistant, and breathable while remaining lightweight. There is also a need for a method for preparing garments or coverings from such fabrics and the garments and coverings made therefrom. There is particularly a need in the glass industry for a protective garment that is lightweight, provides improved cut and/or abrasion resistance and covers particularly the vulnerable areas of the upper body of the worker.

SUMMARY OF THE INVENTION

It is an object of the present invention to overcome these or other disadvantages of known cut, slash and/or abrasion resistant fabrics.

It is a further object of the present invention to provide a method to prepare a cut, slash and/or abrasion resistant garment or covering that is able to provide a satisfactory level of cut, slash and/or abrasion resistance protection to the wearer, able to resist damage, is light-weight, comfortable, able to permit airflow therethrough, and able to permit the escape of excess water vapor from the skin of the wearer.

These and other objects of the present invention can be provided by a shaped knit garment, wherein the entire garment comprises at least one cut, slash and/or abrasion resistant yarn, wherein the shaped knit fabric panel has a cut resistance of at least 1500 (as measured by ASTM-F1790-2005) and preferably a fabric weight of no more than 27.9 ounces/square yard (OPSY), wherein the garment is prepared using one or more shaped knit fabric panels which are joined using one or more cut, slash and/or abrasion resistant composite yarns, to provide the seams with the same cut, slash and/or abrasion resistance as the shaped knit fabric panels of the garment.

BRIEF DESCRIPTION OF THE DRAWINGS

A more complete appreciation of the present invention, and many of the attendant advantages thereof, will be readily ascertained and obtained as the same becomes better understood by reference to the following detailed description when considered in connection with the accompanying drawings, wherein.

DETAILED DESCRIPTION OF THE INVENTION

Figure 1:
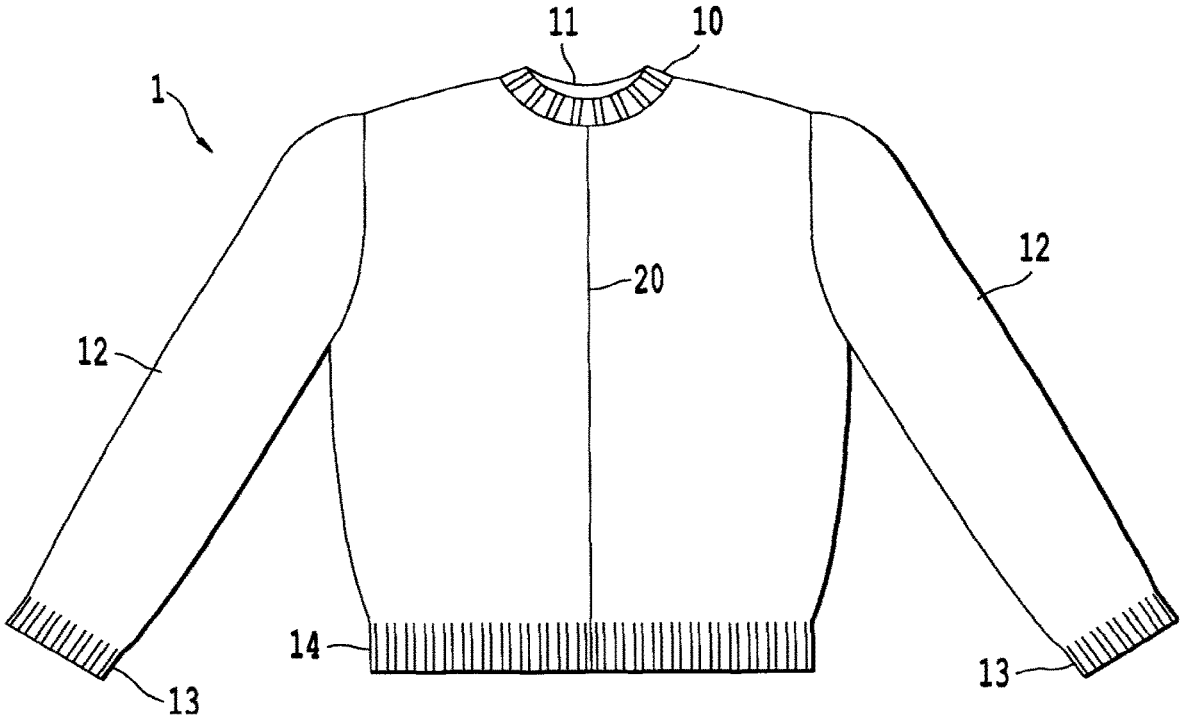
FIG. 1 is an exemplary embodiment of a sweater according to the present invention.

The term "fiber" as used herein refers to a fundamental component used in the assembly of yarns and fabrics. Generally, a fiber is a component which has a length dimension which is much greater than its diameter or width. This term includes ribbon, strip, staple, and other forms of chopped, cut or discontinuous fiber and the like having a regular or irregular cross section. "Fiber" also includes a plurality of any one of the above or a combination of the above.

As used herein, the term "high performance fiber" means that class of synthetic or natural non-glass fibers having high values of tenacity greater than 10 g/denier, such that they lend themselves for applications where high abrasion and/or cut resistance is important. Typically, high performance fibers have a very high degree of molecular orientation and crystallinity in the final fiber structure. An example of such would be high molecular weight polyethylene (HMWPE) or extended chain polyolefins.

The term "filament" as used herein refers to a fiber of indefinite or extreme length such as found naturally in silk. This term also refers to manufactured fibers produced by, among other things, extrusion processes. Individual filaments making up a fiber may have any one of a variety of cross sections to include round, serrated or crenular, bean-shaped or others.

The term "yarn" as used herein refers to a continuous strand of textile fibers, filaments or material in a form suitable for knitting, weaving, or otherwise intertwining to form a textile fabric. Yarn can occur in a variety of forms to include a spun yarn consisting of staple fibers usually bound together by twist; a multi filament yarn consisting of many continuous filaments or strands; or a mono filament yarn which consist of a single strand.

The term "composite yarn" (or "engineered yarn") refers to a yarn prepared from two or more yarns (or "ends"), which can be the same or different. Composite yarn can occur in a variety of forms wherein the two or more ends are in differing orientations relative to one another, so long as the final composite yarn containing the two or more ends is stably assembled (i.e. will remain intact unless forcibly separated or disassembled). The two or more ends can, for example, be parallel, wrapped one around the other(s), twisted together, or combinations of any or all of these, as well as other orientations, depending on the properties of the composite yarn desired. Suitable composite yarns, which may be formed into fabric by any desired process, preferably knit or woven into the fabric, include, but are not limited to, those as described in U.S. Pat. Nos. 4,777,789, 4,838,017, 4,936,085, 5,177,948, 5,628,172, 5,632,137, 5,644,907, 5,655,358, 5,845,476, 6,212,914, 6,230,524, 6,341,483, 6,349,531, 6,363,703, 6,367,290, and 6,381,940, each to Kolmes, the contents of each of which are hereby incorporated by reference. Another term by which composite yarns are known is "engineered yarn".

The present invention relates to a shaped knit protective garment having a cut resistance of at least 1500, according to the ASTM-F1790-2005.

The shaped knit protective garment of the present invention comprises sufficient cut, slash and/or abrasion resistant yarn to provide the fabric with the necessary level of cut resistance, such that the fabric has a cut resistance of at least 1500 as measured by ASTM-F1790-2005, the entire contents of which are hereby incorporated by reference. These cut, slash and/or abrasion resistant yarns can be any high performance yarn, a composite yarn, a yarn blend comprising one or more high performance or composite yarns, etc. Preferably, the cut, slash and/or abrasion resistant yarns comprise one or more yarns selected from polyolefins (such as ultra high molecular weight polyethylene or extended chain polyolefin), aramids, continuous filament glass fiber, filament stainless steel, and flat or spun synthetic thermoplastic yarns, such as polyester or nylon. The garment preferably has a cut resistance of from 1500 to 6200, more preferably from 2000 to 6200, most preferably having a cut resistance in the area of the cuffs of 2500 to 6200. The garment preferably is a jacket and most preferably is made from 100% of one or more cut, slash and/or abrasion resistant yarns, including the yarns making up the shaped knit panels, as well as including the yarn with which the panels are joined together (i.e. all yarns used in construction of the garment are cut, slash and/or abrasion resistant). In this preferred embodiment, the only portion of the jacket that would not be made of the one or more cut, slash and/or abrasion resistant yarns is the zipper on the front (or back) of the jacket, which is preferably a plastic zipper that is fully hidden during manufacturing and use. It can not damage glass products, and stops short of the top of the neck to avoid pinching.

In addition, the knitting of the garment may be performed, if desired, by plaiting the yarns during knitting. Within the context of the present invention, the term "plaiting" is given its normal meaning within the art, namely "plaiting" applies to knitting two different yarns simultaneously in the same row of stitches, such that one of the yarns covers the other.

In a less preferred embodiment, the garment may contain one or more cut, slash and/or abrasion resistant yarns, either alone or in combination with any other natural or synthetic fiber. Such natural or synthetic fibers include, but are not limited to, cotton, wool, nylon, polyester, rayon, cellulose acetate, etc. and in conjunction with using Lycra or Spandex for improved characteristics.

The fabric of the present invention further has a fabric weight that is sufficiently lightweight to be practical for wearing, having a fabric weight of no more than 27.9 ounces/square yard (OPSY), preferably a fabric weight of from 7 to 27.9 OPSY, more preferably from 8 to 20 OPSY, most preferably from 8 to 17 OPSY.

The protective garments of the present invention are made from the protective fabric and can be any form of garment, including, but not limited to, shirts (including tee-shirts, and with or without sleeves), socks, sweaters, jackets, vests, undergarments (including, but not limited to, pantyhose), pants, jumpsuits, dickeys, head coverings, and sleeves. For high risk industries, the protective garment is preferably a sweater or jacket. The sweater or jacket can be entirely a shaped knit garment, having no zipper or other connective device, or can have a connective device such as a zipper, or hook and loop connectors (such as VELCRO-type closures). When a zipper is present, it is preferred that the zipper is made of a material, such as plastic, that will not damage the products being handled in the industry, such as glass. The protective garment of the present invention can provide one or more of the following advantages, including the prevention or reduction of injury to the wearer, resistance to damage, and light-weight construction. In a preferred embodiment of the invention, the protective garment comprises a fabric made entirely from cut, slash and/or abrasion resistant composite yarns. The garments are made according to any known method useful for preparing garments from fabrics. Preferably, the garments are made by shaped knitting during preparation of the fabric. Shaped knitting is a process by which the various panels of a garment are formed directly in the shape needed for assembly, during the knitting process. This is preferred for the present invention, since the fabrics of the present invention have cut and slash resistance and are therefore extremely difficult to cut using conventional fabric cutting means. While it is possible to cut the fabric, the cutting process is very hard on the cutting surfaces, significantly reducing the interval between servicing of the cutting equipment, and thus increasing the cost of operations. Accordingly, shaped knitting is preferably used to prepare the panels of fabric which are assembled to prepare the present invention garments. These panels are then linked together to form the garment. Many types of seam construction can be used to attach panels to one another. Since these panels have been shaped during their construction, linking, looping of collars or cup seaming are the most preferred, due to the higher comfort provided by the seam against the wearer's skin as well as strength. The Knit Construction may be in various Gauges such as 3, 4, 5, 6, 7, 8, 10, 12, 13, 14, 16, and 18 gauges wherein within the context of the present invention, the term "gauge" means needles per inch on the specific machine on which the pieces are knit. By way of example, 18 Gauge would normally make a fine textured piece, whereas a 3 gauge piece would normally be of a coarser texture.

In a preferred embodiment, the fabric is prepared into a garment or other type of covering that is seamless. Such garments or coverings can be prepared using a knitting machine such as the "WholeGarment" machine sold by Shima Seiki of Japan, or the Knit-To-Wear machinery of Stoll Gmbh. of Germany. These garments could have any desired construction, but would typically be substantially tubular knit in construction, although the tubular construction could have apertures through which appendages could protrude when wearing the garment.

The preferred jacket or sweater garment of the present invention provides the following advantages, among others:

1) As a knit, the garment can stretch in every direction providing superior comfort and closer fit than any woven fabric, which stretches only on the bias, can offer.
2) The jacket has greater cut resistance than protection currently being used in the glass industry. The body of the garment has a cut test result of 2173.9 and the most preferred reinforced extended (preferably 9") cuff has an (ASTM 1790-2005) cut test of 2761.6—a high level 4. A woven aramid jacket tested using the same methods provides a typical cut test result of only 1120.3.
3) The extra yarn in the most preferred extended cuff eliminates the need for additional guarding in the wrist area and it is not removable for safety.
4) In the application tested, the life expectancy of a woven aramid jacket was approximately (3) months. The garment of the present invention has shown a life expectancy exceeding 8 months or more, with typically only minor damage to the lower front waist area.
5) Flexing the arm of a conventional aramid jacket can expose an area of the wrist between the lower cuff of the jacket and the cuff of a glove. The preferred jacket of the present invention has an elastic loop fixed into the inside of the cuff to be placed over the thumb holding the cuff in position and eliminating this potentially hazardous situation.
6) The present invention preferred jacket has no metal grommets for extra protection, or breath-ability. The use of the shaped knit fabric in constructing the present invention preferred garment permits the fabric to breathe well and does not need this extra protection.
7) Grommets can scratch soft glass surfaces. The most preferred jacket embodiment of the present invention has a comfortable full length zipper, made of plastic (not brass or other metal) that is fully hidden during manufacturing. It can not damage glass products, and preferably stops short of the top of the neck to avoid pinching.
8) The preferred garment of the present invention is linked together with the same (or a different) composite yarn as that from which the jacket is made. This eliminates any weak areas and is not as subject to failure.
9) The preferred semi-turtleneck collar (preferably 2" in width) is most preferably a two bed full rib construction and is doubled over for extra protection and comfort.
10) The upper sleeves of the preferred jacket embodiment can be made in any desired color, particularly in a high visibility color such as bright orange, for high visibility to management, while the remainder of the jacket can be any desired color, preferably a muted color such as grey to hide dirt between launderings.
11) The garment of the present invention is washable, washable in bleach, soft, comfortable, and generally maintenance-free. It does not break down with UV light, most chemicals, salt water, or temperature extremes.
12) The garment of the present invention can be made in many colors, and, if desired, can be made permanently antimicrobial. This antimicrobial treatment, described in U.S. patent application Ser. No. 10/785,060, the entire contents of which are hereby incorporated by reference, can withstand up to (50) launderings and is completely safe containing no polluting heavy metals.

In preparing the garment of the present invention, the garment can be further modified and specialized by any one or more of the following:

1) Attaching patches of cut and/or abrasion resistant material to specific areas where necessary.

2) Changing the yarn in certain areas of the garment to provide different feel, look, color, etc.

3) Adding or removing yarn ends in any area of a garment to provide varying feel, thickness, density, etc.

4) Changing the physical knit stitch structure in any area of a garment to change feel, look, breathability, etc.

5) Changing the knitting gauge within a garment, again to alter the feel, look, density, thickness, etc.

Further, the yarns used in the present invention garment can be subjected to any of a variety of treatments conventional in the art, or described in the above noted "Kolmes" patents, such as fire retardant treatment, antimicrobial treatments, or surface coatings of the yarn or knit fabric to provide or enhance a desired property. The present invention garment can also be provided in any desired color, by dyeing the finished garment, forming the garment from previously colored yarns, or a combination thereof.

EXAMPLES

As an example of a garment prepared according to the present invention, FIG. 1 shows an example of a knit sweater or jacket construction. The sweater can have any desired measurements, depending on the size of the intended wearer. Such sizes and the needed measurements are well known in the art. For example, a knit sweater (1) as shown in FIG. 1 would typically have a rib (10) around the neck opening (11) approximately 1 inch wide, with a front neck drop of 4-4.75 inches and a back neck drop of about 1 inch. The sleeves (12) would typically have a rib (13) at the end approximately 2.5 inches wide. The bottom of the sweater torso would likewise have a rib (14) of approximately 2.5 inches width. The line indicates as (20) represents a zipper, which may optionally be present, depending on whether the garment is a sweater (no zipper) or a jacket (with zipper).

Figure 2A:
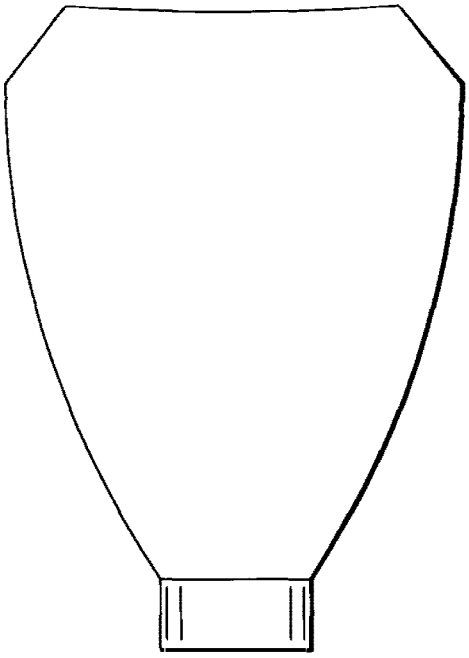
FIGS. 2A-2C show shaped knit fabric panels according to a preferred embodiment of the present invention, as would be used to assemble a sweater according to FIG. 1.
Figure 2C:
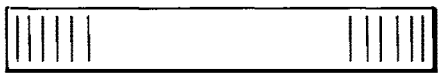
Figure 2B:
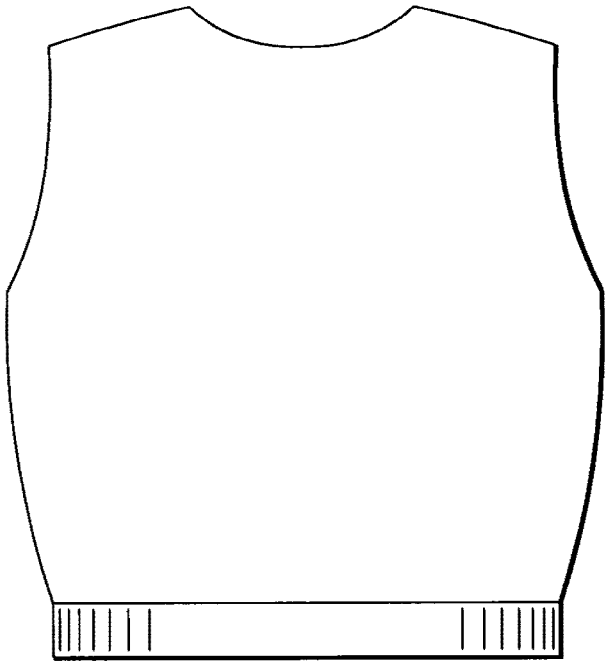

FIGS. 2A-2C show the shaped knit fabric panels that would be used to prepare a preferred embodiment of sweater similar to that in FIG. 1. FIG. 2A shows a shaped knit panel that would be used to prepare the sleeves of a sweater such as in FIG. 1. The sleeve would be formed by joining the right and left edges of the shaped panel in a seam to form a substantially cylindrical sleeve that tapers from one end to the other, with the wider end then being attached to the torso panels. FIG. 2B shows a shaped knit panel that would be used to form a front or back panel of the sweater (with the primary difference being the amount of neck drop). A front panel and back panel would be joined together along the appropriate edges, leaving openings for the neck and sleeves and bottom opening. FIG. 2C shows a knit rib portion that would then be attached to the neck opening formed by joining of the front and back torso panels. The sizes and measurements of the various panels would be readily ascertainable by one of ordinary skill in the knitting and sewing arts.

Numerous additional modifications and variations of the present invention are possible in light of the above teachings. It is therefore to be understood that within the scope of the appended claims, the present invention may be practiced otherwise than as specifically described herein.

The invention claimed is:

1. A shaped knit garment, consisting essentially of:

one or more fabric panels prepared from yarn consisting of 100% cut, slash and/or abrasion resistant yarn and prepared by shaped knitting, wherein the shaped knit garment has a cut resistance of from 1500 to 6200 (as measured by ASTM-F1790-2005) and a fabric weight of no more than 27.9 ounces per square yard (OPSY), wherein the one or more fabric panels are made by a shaped knitting process by which one or more fabric panels are formed directly during the shape knitting process into the final shape of the garment or shapes needed for assembly into the final shape of the garment, and form an entirety of the garment body and arms, the shaped knit garment is seamless as directly formed or formed by joining the fabric panels using cut, slash and/or abrasion resistant yarn, wherein the garment has cuffs at an end of each arm, wherein the garment is a jacket or a sweater, and wherein the garment contains no metal grommets.

2. The shaped knit garment of claim 1, wherein the cut resistance is from 2000 to 6200.

3. The shaped knit garment of claim 1, wherein the at least one cut, slash and/or abrasion resistant yarn is a high performance yarn.

4. The shaped knit garment of claim 1, wherein the at least one cut, slash and/or abrasion resistant yarn is a composite yarn.

5. The shaped knit garment of claim 1, wherein the garment is a jacket having a zipper from neck to waist.

6. The shaped knit garment of claim 5, wherein the zipper is on a front portion of the jacket.

7. The shaped knit garment of claim 5, wherein the zipper is on a back portion of the jacket.

* * * * *